US007311361B2

(12) United States Patent
Hung

(10) Patent No.: US 7,311,361 B2
(45) Date of Patent: Dec. 25, 2007

(54) APPARATUS FOR SIMULTANEOUSLY FOLDING SEAT BACK AND ARMREST

(76) Inventor: Yu-Ching Hung, 9F-1, No.248, Sec.3, Hueilai Rd., Taichung City (TW) 407

( * ) Notice: Subject to any disclaimer, the term of this patent is extended or adjusted under 35 U.S.C. 154(b) by 5 days.

(21) Appl. No.: 11/307,179

(22) Filed: Jan. 26, 2006

(65) Prior Publication Data

US 2007/0170768 A1 Jul. 26, 2007

(51) Int. Cl.
*A47C 7/54* (2006.01)

(52) U.S. Cl. ..... 297/411.44; 297/411.32; 297/360

(58) Field of Classification Search ..... 297/411.2, 297/411.32, 411.35, 411.44, 360, 411.39, 297/39, 40

See application file for complete search history.

(56) References Cited

U.S. PATENT DOCUMENTS 1,291,413 A * 1/1919 Cluff ..... 297/257
4,252,371 A * 2/1981 Lehnen ..... 297/411.4
4,887,866 A * 12/1989 Rusin ..... 297/411.38
4,889,385 A * 12/1989 Chadwick et al. ..... 297/300.1
5,318,346 A * 6/1994 Roossien et al. ..... 297/300.1
5,630,643 A * 5/1997 Scholten et al. ..... 297/218.2
6,739,669 B2 * 5/2004 Etzioni et al. ..... 297/411.32
6,761,397 B1 * 7/2004 Tseng ..... 297/40
7,147,286 B2 * 12/2006 Cesaroni et al. ..... 297/301.1

* cited by examiner

*Primary Examiner*—Sarah B. McPartlin
(74) *Attorney, Agent, or Firm*—Banger Shia

(57) ABSTRACT

An apparatus for simultaneously folding seat back and armrest, which comprises a seat assembly, a seat back assembly, a pivoting assembly, two armrests and an adjusting assembly. The seat assembly is mounted on a base of a chair. The seat back assembly is pivoted to the seat assembly. The crank is pivoted in the seat assembly in such a manner that both ends of the crank protrude out of the seat assembly, and the protruded ends are swingable along with the rotation of the crank. The two armrests are arranged at both sides of the seat assembly and the seat back assembly; an end of each of the armrests is pivoted to the crank, and another end of the armrests is pivoted to the seat back assembly. The adjusting assembly is disposed between the seat assembly and the seat back assembly for controlling the motion of the seat back assembly and the armrests.

5 Claims, 7 Drawing Sheets

APPARATUS FOR SIMULTANEOUSLY FOLDING SEAT BACK AND ARMREST

BACKGROUND OF THE INVENTION

1. Field of the Invention

The present invention relates to a chair, and more particularly to an apparatus for simultaneously folding seat back and armrest.

2. Description of the Prior Art

A conventional office chair is usually difficult to disassemble after assembly, its configuration and occupied space will increase storage and transportation inconveniences.

The present invention has arisen to mitigate and/or obviate the afore-described disadvantages.

SUMMARY OF THE INVENTION

The primary objective of the present invention is to solve the aforementioned problem of the conventional chair by providing an apparatus for simultaneously folding seat back and armrest, which comprises a seat assembly, a seat back assembly, a pivoting assembly, two armrests and an adjusting assembly. The seat assembly is mounted on a base of a chair. The seat back assembly is pivoted to the seat assembly. The crank is pivoted in the seat assembly in such a manner that both ends of the crank protrude out of the seat assembly, and the protruded ends are swingable along with the rotation of the crank. The two armrests are arranged at both sides of the seat assembly 1 and the seat back assembly; an end of each of the armrests is pivoted to the crank, and another end of the armrests is pivoted to the seat back assembly. The adjusting assembly is disposed between the seat assembly and the seat back assembly for controlling the motion of the seat back assembly and the armrests. Since the seat assembly, the seat back assembly, the crank and the armrests are connected in a pivotal relation to one another, plus the adjusting assembly is disposed between the seat assembly and the seat back assembly for controlling the motion of the seat back assembly and the armrests, such arrangements allow the seat back assembly and the armrests to move pivotally and simultaneously when pushing the adjusting assembly. Meanwhile, the crank will rotate, as a result, the seat back assembly and the armrests will topple forward, thus reducing the storage space and making it easy for transportation.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

The foregoing, and additional objects, features and advantages of the present invention will become apparent from the following detailed description of preferred embodiments thereof, taken in conjunction with the accompanying drawings.

Figure 1:
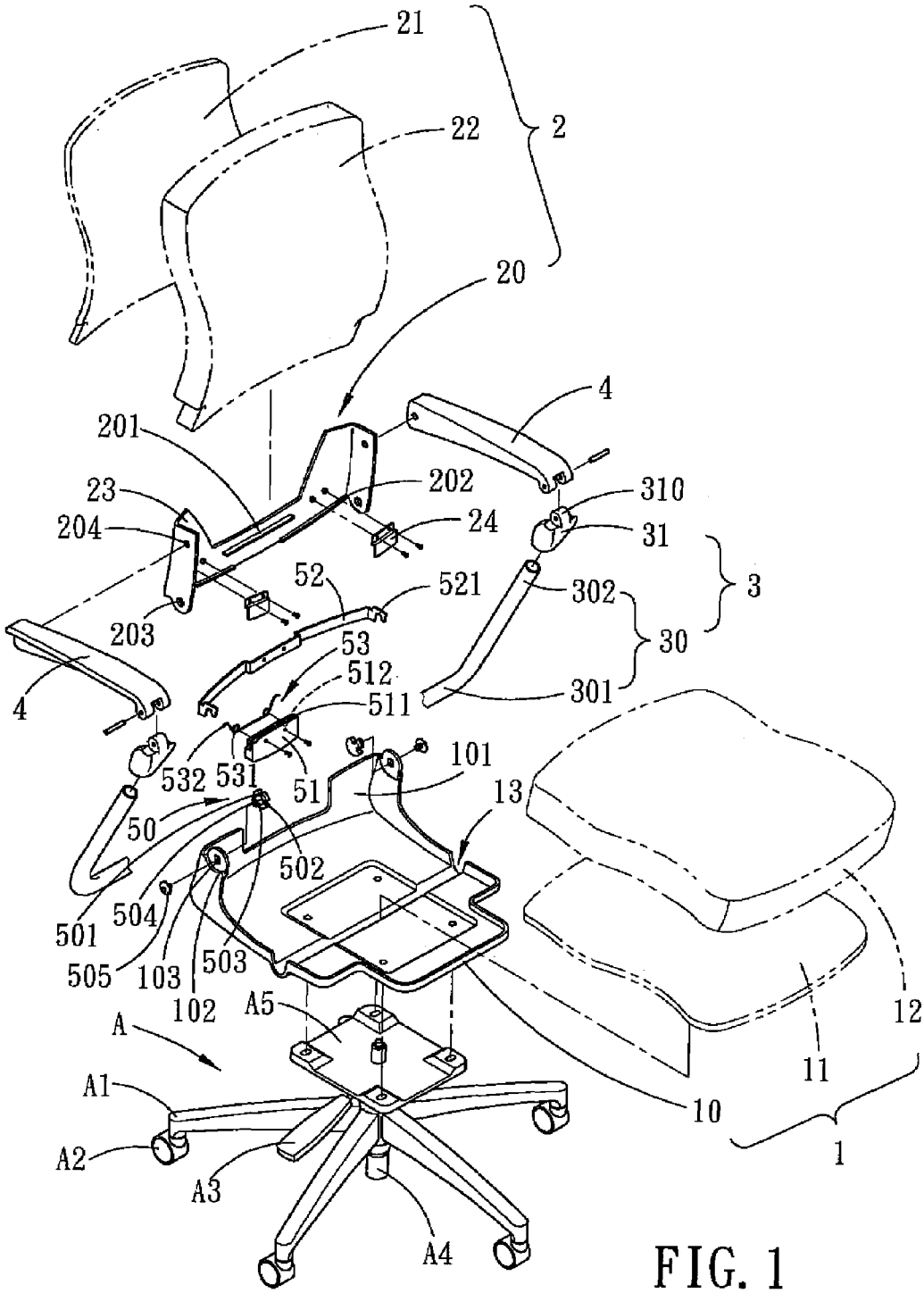
FIG. 1 is an exploded view of an apparatus for simultaneously folding seat back and armrest in accordance with the present invention.
Figure 2:
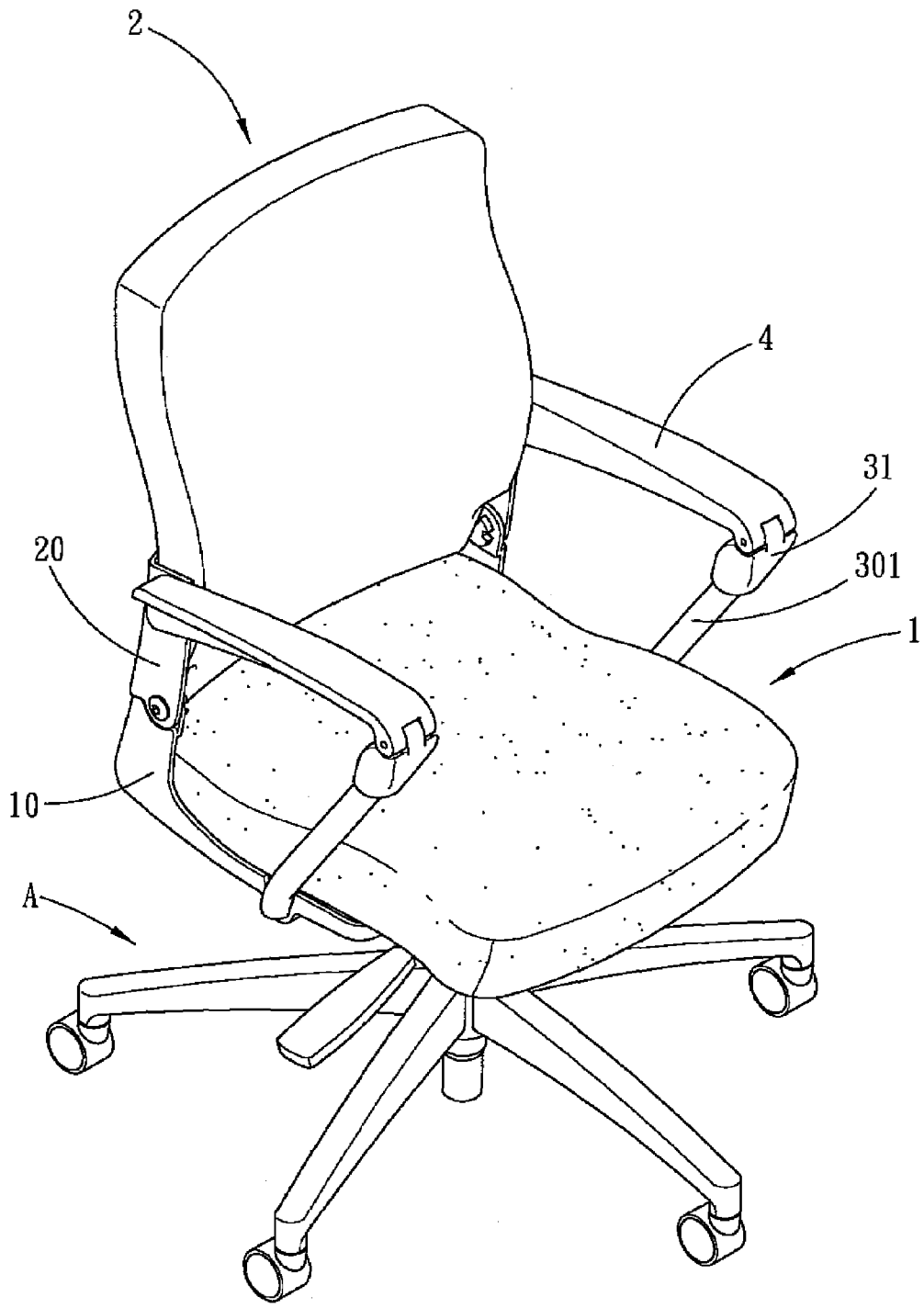
FIG. 2 is an assembly view of the apparatus for simultaneously folding seat back and armrest in accordance with the present invention.

Referring initially to FIGS. 1 and 2, an apparatus for simultaneously folding seat back and armrest in accordance with the present invention is shown, and which is used on a height-adjustable chair.

The apparatus for simultaneously folding seat back and armrest is installed on a base A of a chair and comprises a seat assembly 1, a seat back assembly 2, a pivoting assembly 3, two armrests 4 and an adjusting assembly 5.

The base A is of a conventional structure, so it is briefly explained for making the specification more integral. The base A comprises a leg assembly A1, a plurality of casters A2 and a lift A3. The leg assembly A1 includes a plurality of downward inclined legs arranged in a radial manner. The respective casters A2 are secured to the legs, such that the leg assembly A1 is slidable on the ground. The lift A3 includes a lift rod A4 and an adjusting member A5. The lift rod A4 is slideably disposed in an adjusting hole of the leg assembly A1. The adjusting member A5 is installed at an end of the lift rod A4 for controlling the height of the lift rod A4, so that the height of the seat back structure to be assembled will be adjustable.

The seat assembly 1 includes a lower board 10, an upper board 11 and a cushion 12. A pivoting groove 13 with both ends open is formed in the lower board 10 for installation of the pivoting assembly 3. A side of the lower board 10 is folded upward to form a receiving space 101 with one end open, formed in each sidewall of the open end of the receiving space 101 is a recess 102, and a limiting hole 103 is formed in the center of the recess 102. The upper board 11 is fixed on the lower board 10, and an end of the upper board 11 abuts against the receiving space 101. The cushion 12 is then placed on the upper board 11, and one end of the cushion 12 also abuts against the receiving space 101.

The seat back assembly 2 includes a mounting member 20, a board 21 and a back cushion 22. A receiving recess 23 with both ends open is formed in the mounting member 20, at the bottom of the receiving recess 23 is an upper stopping block 201, and at the edge of the bottom of the receiving recess 23 are two opposite lower stopping blocks 202. A stepped stopping piece 24 is arranged at either side of the upper stopping block 201. A sidewall at either end of the receiving recess 23 is formed with two pivoting hole 203 and 204, the pivoting hole 203 is pivoted with the recess 102 of the seat assembly 1, so that the mounting member 20 is pivotable with respect to the lower board 10. The back cushion 22 is placed on the board 21, and the board 21 is fixed in the receiving recess 23 of the mounting member 20.

The pivoting assembly 3 includes a crank 30 and two pivoting blocks 31. The crank 30 is a rod 301 whose both ends are folded to form a folded portion 302. The rod 301 is confined in the pivoting groove 13 of the seat assembly 1, such that the two folded portions 302 will be swingable relative to two opposite sides of the seat assembly 1 along with the rotation of the crank 30. The end of the respective folded portions 302 is engaged with the pivoting block 31 for positioning other components to be discussed later.

An end of each of the armrests 4 is pivoted to the pivoting holes 204 in the sidewall at both sides of the seat back assembly 2 for the user's arms, and another end of the armrests 4 is pivoted to the pivoting portion 310 of the pivoting assembly 3. The armrests 4 are supported by the folded portions 302 of the crank 30 and positioned at a predetermined positioned for the user's arms to rest on.

The adjusting assembly 5 is disposed between the seat assembly 1 and the seat back assembly 2 for controlling the motion of the seat back assembly 2, and accordingly the armrests 4 will be adjusted in an interlocking manner. The adjusting assembly 5 includes a positioning member 50, an adjusting block 51, an adjusting member 52 and an elastic member 53. The positioning member 50 is radially concaved to form an engaging groove 501 opening upward and an engaging groove 502 opening forward, and the positioning member 50 is axially formed with a limiting protrusion 503. The limiting protrusion 503 of the positioning member 50 is inserted in the limiting hole 102 of the seat assembly 1, and then a screw 505 is screwed through the pivoting hole 203 of the seat back assembly 2 and into the positioning member 50. The mounting member 20 of the seat back assembly 2 is allowed to perform limited rotation with respect to the seat assembly 1.

The adjusting block 51 of the adjusting assembly 5 abuts against the board 21 of the seat back assembly 2, and in the top end of the adjusting block 51 is a groove 511 with both ends open. Two positioning blocks 512 are formed on the rear surface of the adjusting block 51. The positioning blocks 512 are located correspondingly to the upper stopping block 201 of the seat back assembly 2 and serve to abut against the bottom of the receiving recess 23 of the seat back assembly 2.

The mid portion of the adjusting member 52 of the adjusting assembly 5 is received in the groove 511 of the adjusting block 51, both ends of the adjusting member 52 pass through the space above the lower stopping blocks 202 of the seat back assembly 2, and through the stopping pieces 24 of the seat back assembly 2, and then are folded forward along the surface of the receiving recess 23 of the seat back assembly 2, so as to form a hook 521. The hooks 521 of the adjusting member 52 is hooked to the engaging grooves 501 of the positioning member 50.

The elastic member 53 of the adjusting assembly 5 is wound to form two elastic ring portions 531 to be mounted on the positioning blocks 512 of the adjusting block 51. Two elastic portions 532 symmetrically extending upward from the elastic ring portions 531 serve to push the upper stopping block 201 of the seat back assembly 2 upward. According to the abovementioned apparatus for simultaneously folding seat back and armrest, the folded portions 302 of the crank 30 also can be directly pivoted to the armrests 4.

For a better understanding of the present invention, its operation and function, reference should be made to FIGS. 3-7.

Figure 3:
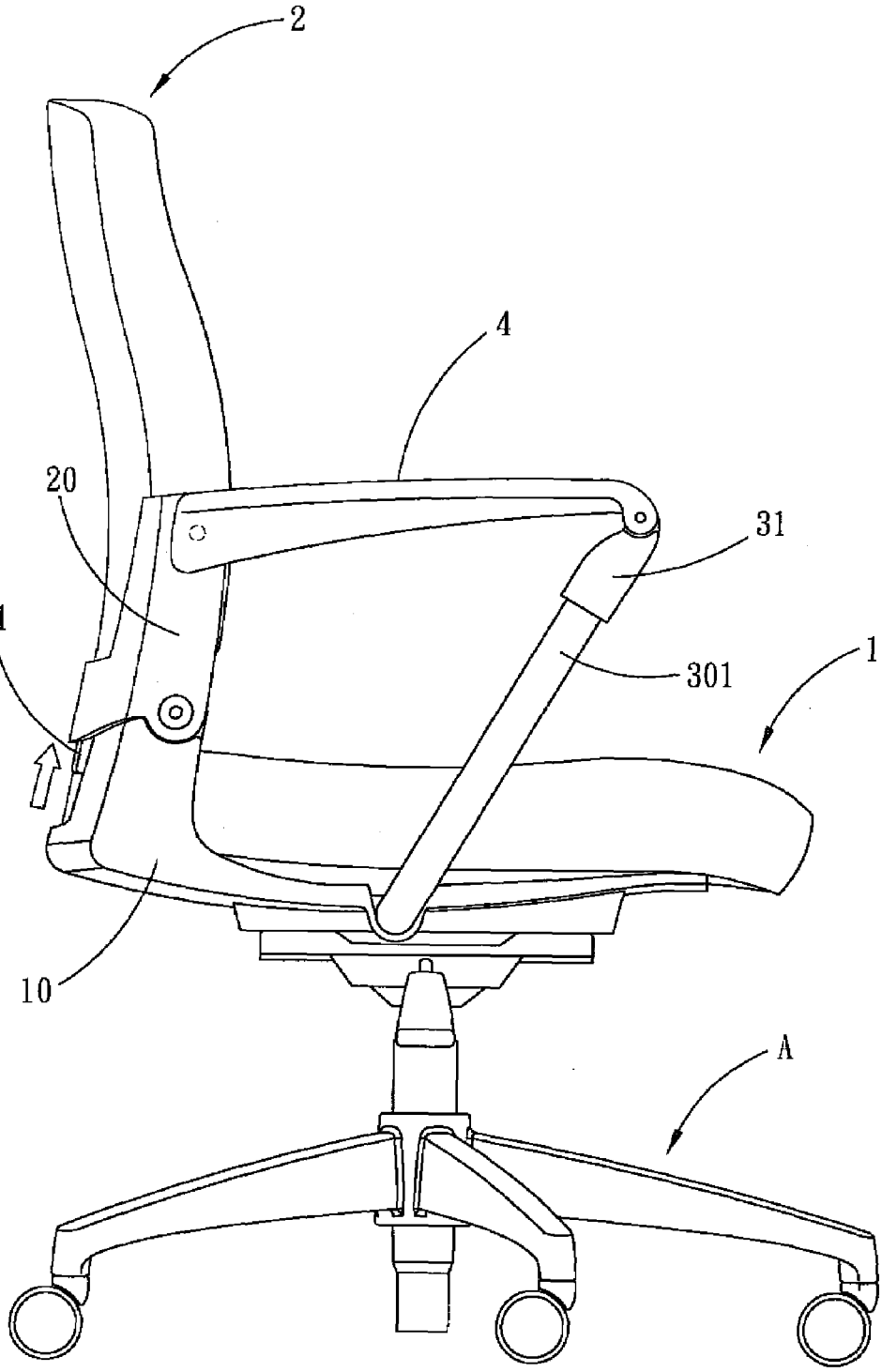
FIG. 3 is a side view of the apparatus for simultaneously folding seat back and armrest in accordance with the present invention.
Figure 4:
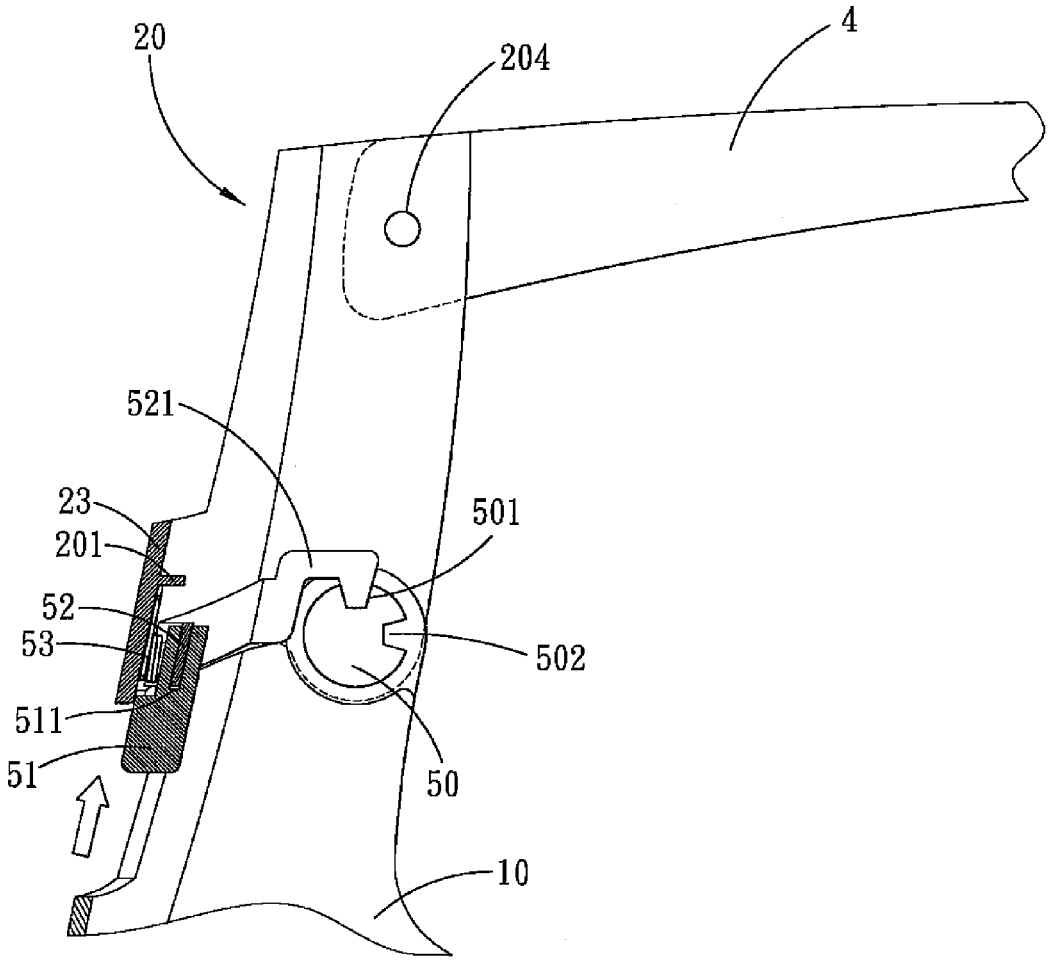
FIG. 4 is an illustrative view of an adjusting assembly of the apparatus for simultaneously folding seat back and armrest in accordance with the present invention.
Figure 5:
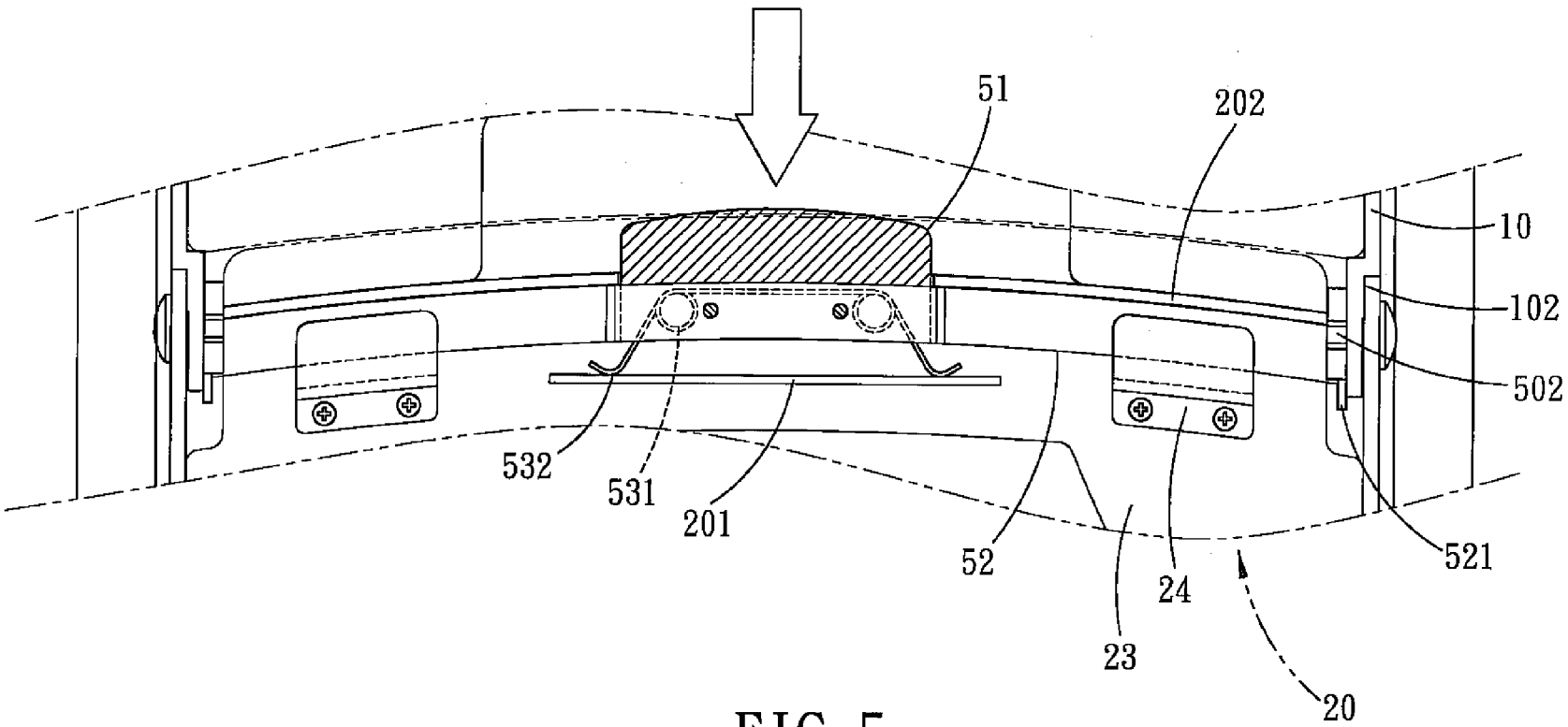
FIG. 5 is a front view of the adjusting assembly of the apparatus for simultaneously folding seat back and armrest in accordance with the present invention.

As shown in FIGS. 3-5, to fold a chair with the apparatus for simultaneously folding seat back and armrest, the user can raise the adjusting member 52 up from the groove 511 of the adjusting block 51 by pressing the adjusting block 51 of the adjusting assembly 5 upward. The stopping pieces 24 of the seat back assembly 2 will limit the upward displacement of the adjusting member 52, and the elastic member 53 mounted on the adjusting block 51 will abut against the upper stopping block 201 of the seat back assembly 2.

Figure 6:
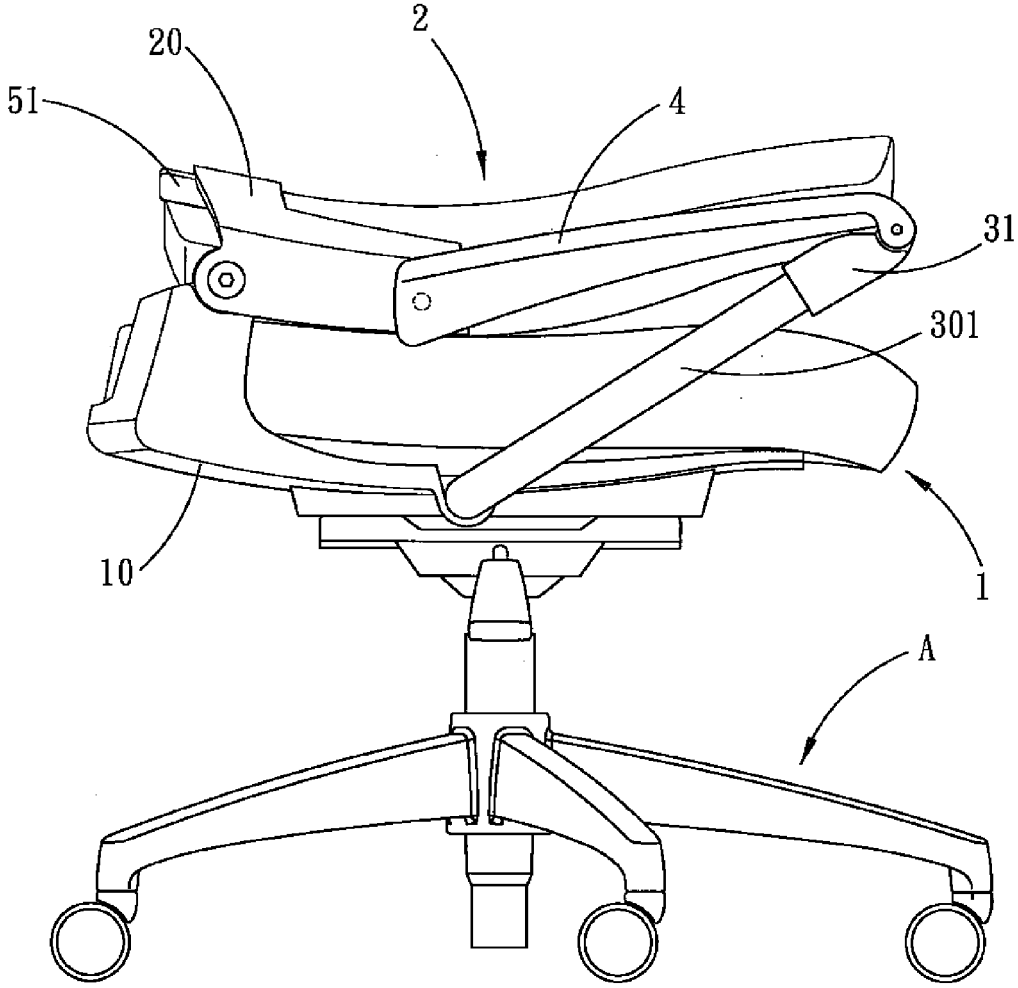
FIG. 6 is a side view of showing a folded status of the adjusting assembly of the apparatus for simultaneously folding seat back and armrest in accordance with the present invention.
Figure 7:
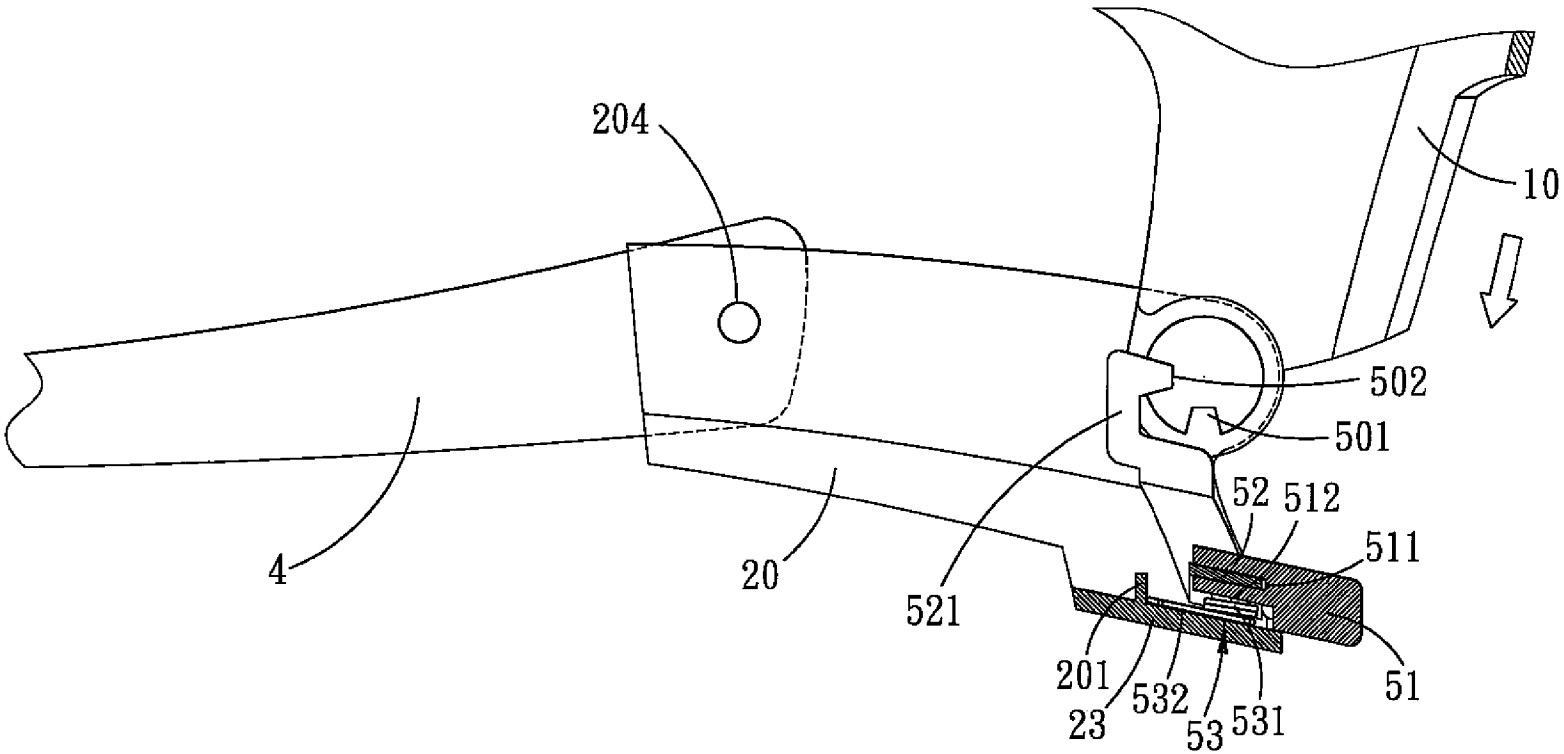
FIG. 7 is an illustrative view of showing the folded status of an adjusting assembly of the apparatus for simultaneously folding seat back and armrest in accordance with the present invention.

Referring to FIG. 6 and 7, when the adjusting member 51 of the adjusting assembly 5 moves upward, the hook 521 will disengage from the engaging groove 501 of the elastic member 53. At this moment, the user can push the seat back assembly 2, and the seat back assembly 2 will topple forward since the mounting member 20 is pivoted with respect to the receiving space 101 of the seat back assembly 1. The forward fall of the seat back assembly 2 will make the armrests 4 pivoted thereto rotate toward the seat assembly 1 and will make the crank 30 of the pivoting assembly 3 swing forward. As a result, the seat back assembly 2 will be lowered on the seat assembly 1, and the armrests 4 will move to either side of the seat assembly 2. At the same time, the hook 521 of the adjusting assembly 5 will be aligned to the engaging groove 502. In this way, the armrests and the seat back are folded simultaneously.

After that, the user releases the adjusting block 51 of the adjusting assembly 5, the adjusting block 51 will be pushed back to its original position by the elastic member 53, and the hook 521 of the adjusting assembly 5 will be engaged in the engaging groove 502. In this way, the seat back assembly 2 can be firmly positioned on the seat assembly 1, making it easy for storage and transportation.

If want to unfold the seat back assembly 2, the user only needs to pull the seat back assembly 2 upward, so as to make the hook 521 of the adjusting assembly 5 reengage in the engaging groove 501 of the positioning member 50, thus driving the armrests 4 and the pivoting assembly 3 back to their original positions.

While we have shown and described various embodiments in accordance with the present invention, it should be clear to those skilled in the art that further embodiments may be made without departing from the scope of the present invention.

What is claimed is:

1. An apparatus for simultaneously folding a seat back and an armrest, installed on a base of a chair, comprising: a seat assembly mounted on the base of the chair; a seat back assembly pivoted to the seat assembly; a pivoting assembly pivoted in the seat assembly and both ends of the pivoting assembly protrude out of the seat assembly; two armrests arranged at both sides of the seat assembly and the seat back assembly, an end of each of the armrests is pivoted to the seat back assembly, and another end of the armrests is pivoted to the pivoting assembly; and an adjusting assembly disposed between the seat assembly and the seat back assembly for controlling motion of the seat back assembly and the armrests; wherein the seat assembly includes: a lower board, a pivoting groove with both ends open is formed in the lower board for receiving said pivoting assembly therein, a side of the lower board is folded upward to form a receiving space, sidewalls are located at each side of said receiving space, a recess is formed in each sidewall, and a limiting hole is formed in a center of the recess; an upper board fixed on the lower board and covering the pivoting assembly, an end of the upper board abuts against the receiving space; and a cushion placed on the upper board, one end of the cushion abuts against the receiving space.

2. The apparatus for simultaneously folding a seat back and an armrest as claimed in claim 1, wherein the seat back assembly includes: a mounting member, a receiving recess with both ends open is formed in the mounting member, at a bottom of the receiving recess is an upper stopping block, and at an edge of the bottom of the receiving recess are two opposite lower stopping blocks, a stepped stopping piece is arranged at either side of the upper stopping block, a sidewall at either end of the receiving recess is formed with two pivoting holes and, one of the two pivoting holes is pivoted with the recess of the seat assembly, so that the mounting member is pivotable with respect to the lower board; a board fixed on the mounting member; and a cushion placed on the board.

3. The apparatus for simultaneously folding a seat back and an armrest as claimed in claim 2, wherein the pivoting assembly includes a crank and two pivoting blocks; the crank is a rod whose both ends are folded to form a folded portion, the rod is confined in the pivoting groove, the two folded portions protrude out of the pivoting groove and are swingable relative to two opposite sides of the seat assembly along with rotation of the crank; an end of the respective pivoting blocks is engaged with the folded portions at both ends of the crank, and another end of the pivoting blocks is formed with a pivoting portion.

4. The apparatus for simultaneously folding a seat back and an armrest as claimed in claim 3, wherein an end of each of the armrests is pivoted in the other of the two pivoting holes formed in the sidewall of the mounting member, and another end of the armrests is pivoted to the pivoting portion of the pivoting assembly, the armrests are supported by the folded portions of the crank and positioned at a predetermined position for the user's arms to rest on.

5. The apparatus for simultaneously folding a seat back and an armrest as claimed in claim 4, wherein the adjusting assembly includes a positioning member, the positioning member is radially concaved to form an engaging groove opening upward and an engaging groove opening forward, and the positioning member is axially formed with a limiting protrusion, a threaded groove is formed in the limiting protrusion and extends in the axial direction thereof, the limiting protrusion of the positioning member is inserted in the limiting hole of the seat assembly, and then a screw is screwed through the one of the two pivoting holes of the mounting member and into the threaded groove of the positioning member, by such arrangements, the mounting member of the seat back assembly is allowed to perform limited rotation with respect to the seat assembly;

an adjusting block of the adjusting assembly abuts against the board of the seat back assembly, and in a top end of the adjusting block is a groove with both ends open, two positioning blocks are formed on a rear surface of the adjusting block, the positioning blocks are located correspondingly to the upper stopping block of the seat back assembly and serve to abut against the bottom of the receiving recess of the seat back assembly; a mid portion of an adjusting member of the adjusting assembly is received in the groove of the adjusting block, both ends of the adjusting member pass through a space above the lower stopping blocks of the seat back assembly, and through the stopping pieces of the seat back assembly, and both ends of the adjusting member are folded forward , so as to form a hook, the hook of the adjusting member positioned for engagement with the engaging grooves of the positioning member; and an elastic member of the adjusting assembly is wound to form two elastic ring portions to be mounted on the positioning blocks of the adjusting block, two elastic portions symmetrically extending upward from the elastic ring portions serve to push the upper stopping block of the seat back assembly upward.

* * * * *